United States Patent [19]

Imai et al.

[11] Patent Number: 4,871,162

[45] Date of Patent: Oct. 3, 1989

[54] SHEET TAKE-OUT APPARATUS

[76] Inventors: Shigetoshi Imai, 4-17, Torikaihaccho 1-chome, Settsu-shi, Osaka-fu; Takao Akioka, 5-10, Minamimukonoso 1-chome, Amagasaki-shi, Hyogo-ken, both of Japan

[21] Appl. No.: 160,284

[22] Filed: Feb. 25, 1988

[30] Foreign Application Priority Data

Feb. 26, 1987 [JP] Japan ..... 62-27636[U]

[51] Int. Cl.[4] ..... B65H 3/04

[52] U.S. Cl. ..... 271/35; 271/122

[58] Field of Search ..... 271/122, 124, 35

[56] References Cited

U.S. PATENT DOCUMENTS

| | | | |
|---|---|---|---|
| 4,085,929 | 4/1978 | Tuchiya et al. | 271/122 |
| 4,105,199 | 8/1978 | Sato et al. | 271/122 |
| 4,216,952 | 8/1980 | McInerny | 271/122 |
| 4,330,115 | 5/1982 | Mouri et al. | 271/124 |
| 4,416,449 | 11/1983 | McInerny | 271/122 |
| 4,575,068 | 3/1986 | Kato | 271/122 |

FOREIGN PATENT DOCUMENTS

| | | | |
|---|---|---|---|
| 2308794 | 8/1973 | Fed. Rep. of Germany . | |
| 2730766 | 1/1978 | Fed. Rep. of Germany . | |
| 115072 | 9/1977 | Japan . | |
| 198242 | 11/1984 | Japan | 271/122 |

*Primary Examiner*—Kevin P. Shaver
*Assistant Examiner*—Kenneth Noland
*Attorney, Agent, or Firm*—Fleit, Jacobson, Cohn, Price, Holman & Stern

[57] ABSTRACT

A sheet take-out apparatus for taking out sheets one by one from a stacker including a feed roller for feeding sheets one by one by engaging with the surface of the sheet in the stacker, one or more take-out rollers having at least one groove extending circumferentially on the peripheral surface thereof, the take-out roller being disposed downstream of the feed roller with respect to the direction of the feeding of sheets and rotated synchronously with the rotation of the feed roller, a plurality of pulleys disposed so as to face the one groove and rotated in the opposite direction to that of the sheet feeding, and one or more endless belt made of frictional material, the endless belt being mounted on a plurality of the pulleys so that a part of the endless belt is positioned in the groove and moved in the direction opposite to that of the sheet feeding, the sheets being fed by being held between the peripheral surface of the take-out roller and the endless belt.

4 Claims, 5 Drawing Sheets

SHEET TAKE-OUT APPARATUS

BACKGROUND OF THE INVENTION

The present invention relates to a sheet take-out apparatus for taking out sheets one by one, and particularly to such an apparatus assembled in a sheet processing apparatus such as a sheet counter for taking sheets out one by one from a sheet stacker.

DESCRIPTION OF PRIOR ART

In a sheet processing apparatus such as a sheet counter and a cash dispenser, there is provided a sheet take-out apparatus for taking out sheets one by one from a stacker where a lot of sheets are piled up. Unexamined Japanese Patent Publication No. 52 (1977)-115072 discloses such an apparatus for taking out sheets in which there is provided an endless belt driven by drive rollers in such a manner that the portion of the endless belt unsupported by the drive rollers is pressed onto a peripheral portion of a take-out roller and that the endless belts rotates in the opposite direction to that of take-out the sheet, and which prevents two or more sheets from being taken out simultaneously.

However, in this prior art apparatus, the following problems arise.

(1) Since only the unsupported portion of the endless belt presses on the peripheral portion of the take-out roller, if two or more sheets are simultaneously taken out by the take-out roller from a stacker in such a manner that they are piled up, it is often difficult to remove the residual sheets from a sheet to be taken out and take sheets out one by one.

(2) Since the sheet to be taken out is positioned closest to the take-out roller and usually precedes the residual sheets, this problem can be solved by providing a means for transporting the sheets at a faster speed at the step following the take-out step. However, such a solution makes the control system complicated. Further, in cases where the such means is provided, noise is inevitably generated.

SUMMARY OF THE INVENTION

It is therefore the object of the present invention to provide a sheet take-out apparatus capable of taking out sheets one by one without fail.

According to the present invention, the above and other objects can be accomplished by a sheet take-out apparatus for taking out sheets one by one from stacker means, said sheet take-out apparatus comprising feed roller means for feeding sheets one by one by engaging with the surface of the sheet in said stacker means, take-out roller means having at least one groove extending circumferentially on the peripheral surface thereof, said take-out roller means being disposed downstream of said feed roller means with respect to the direction of sheet feed and rotated synchronously with the rotation of said feed roller means, a plurality of pulley means disposed so as to face said groove and rotated in the opposite direction to that of the sheet feed, and endless belt means made of frictional material, said endless belt means being mounted on said plurality of pulley means so that a part of said endless belt means is positioned in said groove and moved in the opposite direction to that of the sheet feed, said sheets being fed by being held between the peripheral surface of said take-out roller means and said endless belt means.

The above and other objects and features of the present invention will be apparent from the following description made with reference to the accompanying drawings.

DESCRIPTION OF THE PREFERRED EMBODIMENTS

Figure 1:
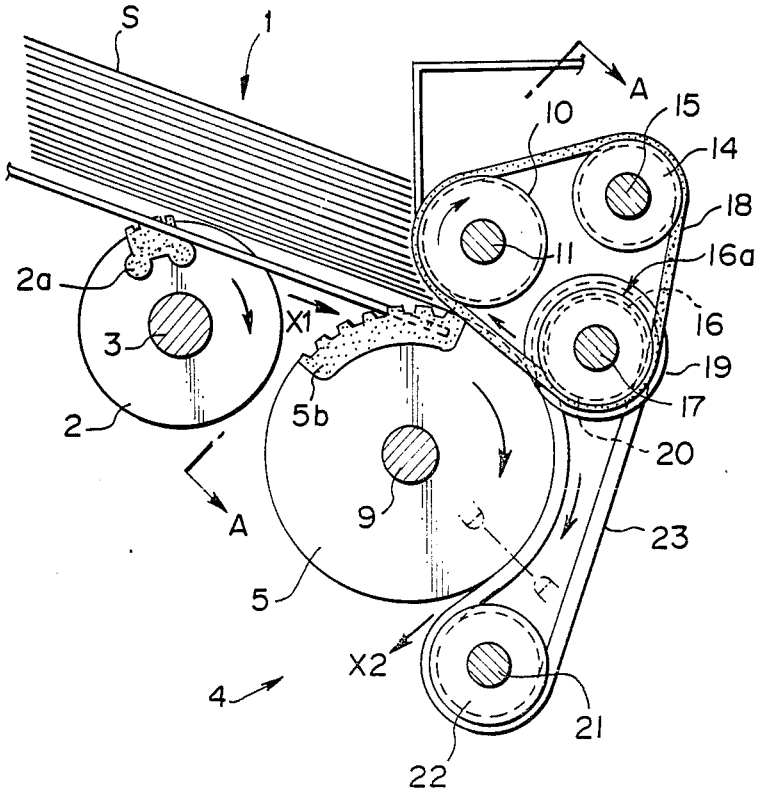
FIG. 1 is a schematic drawing showing a side view of sheet take-out apparatus which is an embodiment of the present invention.
Figure 2:
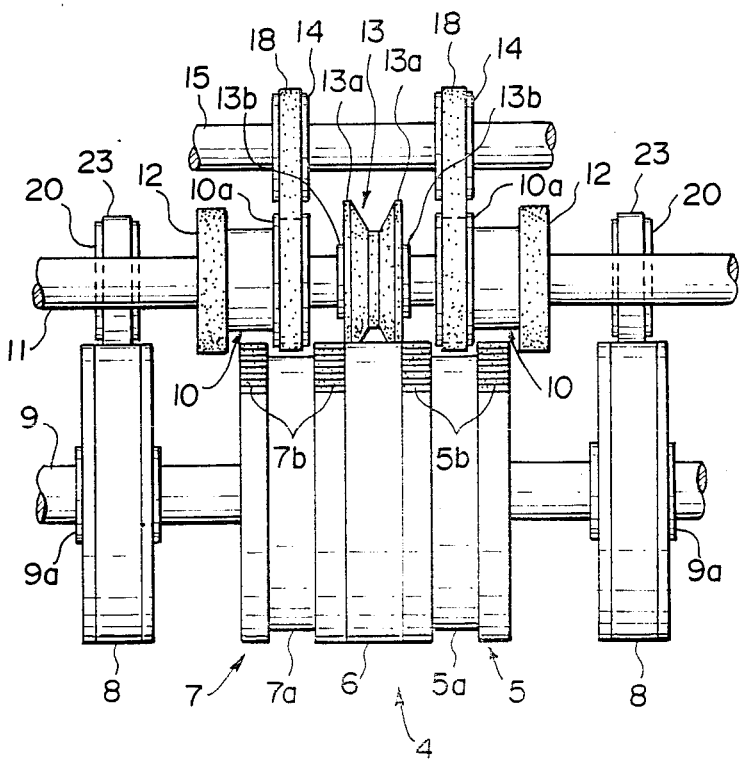
FIG. 2 is a schematic drawing showing a cross-sectional view taken along line A—A in FIG. 1.

Referring to FIGS. 1 and 2, sheets S are stacked in a stacker 1 and a feed roller 2 provided in such a manner that it contacts a lowermost sheet is secured to a rotatable shaft 3. A part of the peripheral portion 2*a* of the feed roller 2 is made of a frictional material such as rubber to feed the lowermost sheet by friction by a predetermined distance per rotation thereof in the direction indicated by X1 and the other part of the peripheral portion of the feed roller 2 is made of low frictional material such as plastic.

A take-out roller unit 4 consisting of rollers 5, 6 and 7 and guide rollers 8 are provided on the right side of the stacker 1, that is, downstream of the stacker 1 with respect to the direction of the sheet feed. The rollers 5, 6, and 7 are secured to a rotatable shaft 9 driven by a driving means (not shown). The guide rollers 8 are rotatably in one way secured to the shaft 9 via bearings 9*a*. A pair of the rollers 5 and 7 are formed with grooves 5*a* and 7*a* respectively extending circumferentially on the peripheral surfaces thereof. Portions of the peripheral portions 5*b* and 7*b* having a larger diameter formed on each side of the grooves 5*a* and 7*a* are made of frictional material such as rubber to intermittently feed the sheet by friction by a predetermined distance per rotation thereof in the direction indicated by an arrow X2, and the other portions thereof are made of low frictional material such as plastic. The central peripheral portions of the rollers 6 and 8 with respect to the axial direction thereof are made of friction material such as rubber and the other portions are made of low friction material such as plastics. Further, although not shown in FIGS. 1 and 2, the shafts 3 and 9 are connected to each other by a belt so that the rotation of the shaft 9 is transmitted to the shaft 3 so the shafts 3 and 9 rotate synchronously.

A pair of pulleys 10 are secured to the rotatable shaft 11 driven by driving means (not shown) and disposed parallel to the shaft 9 so that there is a small clearance between each pulley 10 and one of the rollers 5 and 7. Each pulley 10 has two portions having a large diameter and one of the portions is formed with a groove 10*a* facing the groove 5*a* of one of the rollers 5 and 7, and the other portion is provided with a ring 12 made of frictional material such as rubber. Further, a roller 13 consisting of rings 13*a* made of frictional material and bearings 13*b* is rotatably mounted on the shaft 11 so that the ring 13*a* thereof presses on the peripheral surface of the roller 6.

Moreover, a pair of pulleys 14 each having a groove 14*a* on the peripheral surface thereof are rotatably mounted on a shaft 15 disposed parallel to the shaft 11 and a pair of pulleys 16 each having a groove 16*a* on the peripheral surface thereof are rotatably mounted on a shaft 17 disposed parallel to the shafts 11 and 15. A pair of first endless belts 18 made of frictional material such as rubber are mounted on the respective grooves 10*a*, 14*a* and 16*a* of the pulleys 10, 14 and 16. Each of the first endless belts 18 is positioned in the groove 5*a* of the roller 5 between the pulleys 10 and 16 and faces a bottom surface of the groove 5*a* from which it is spaced by a small clearance.

Further, a roller 19 is rotatably mounted on the shaft 17 so that it presses on the peripheral surface of the roller 6, and a pair of pulleys 20 each having a groove on the peripheral surface thereof are secured to the shaft 17. Below the rollers 5 and 7 a shaft 21 is disposed parallel to the shaft 17 and a pair of pulleys 22 each having a groove on the peripheral surface thereof are secured to the shaft 21. A pair of second endless belts 23 are mounted on the pulleys 20 and 22 respectively with the surface of each second endless belt 23 pressing on the peripheral surface of one of the guide rollers 8 by tensile force formed therein so that the rotation of each guide roller 8 is transmitted to the shafts 17 and 21.

The mode of operation of the above described sheet take-out apparatus will be described hereinbelow with reference to FIGS. 3 to 6.

Figure 3:
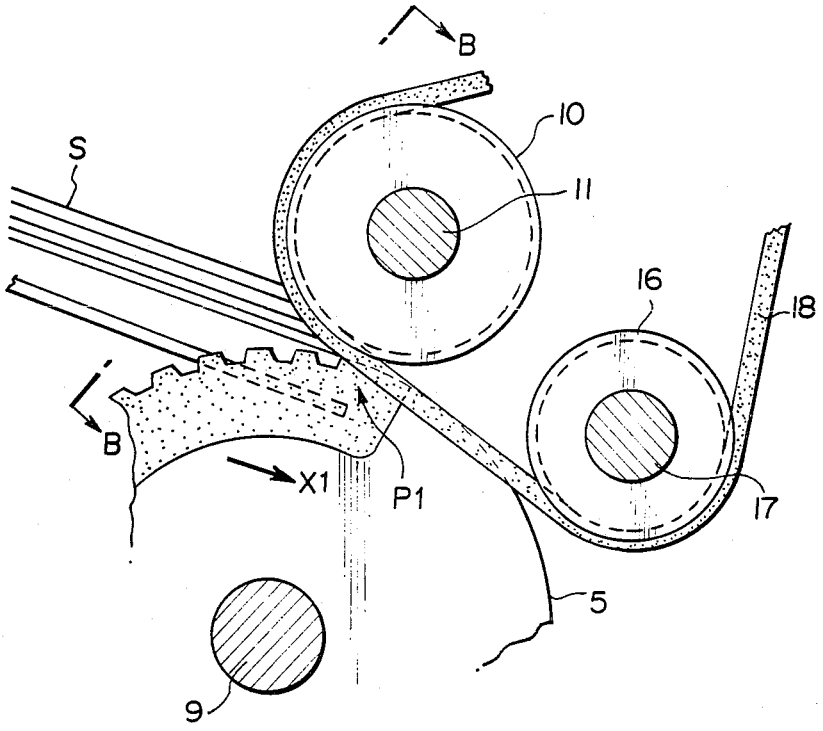
FIGS. 3 to 6 are schematic drawings showing the operation of a sheet take-out apparatus which is an embodiment of the present invention.
Figure 4:
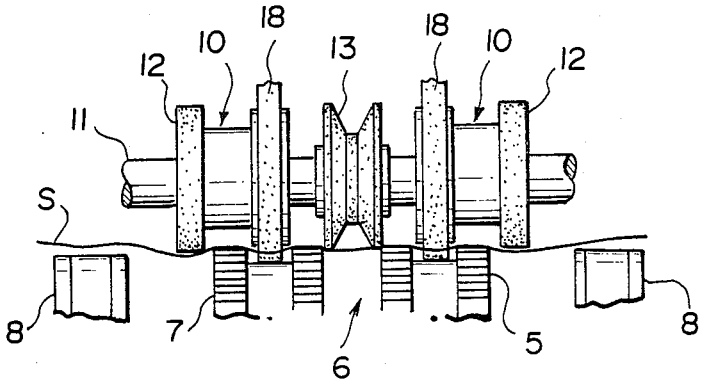

When the operation starts, the feed roller 2, the rollers 5, 6 and 7 forming the take-out roller unit 4 and the guide rollers 8 are rotated in the direction in which the sheets S are fed, while the first endless belts 18 are moved in the opposite direction thereto. The feed roller 2 succesively feeds the sheets S from the stacker 1 to the portion between the rollers 5, 6, 7 and 8 and the first endless belts 18. When the sheets S arrive at the position P1 as shown in FIG. 3 and come to contact with the first endless belts 18 made of frictional material and moving in the opposite direction to that in which the sheets S are fed, the first endless belts 18 backed up by the pulleys 10 force the sheets S into the grooves 5*a* and 7*a* of the rollers 5 and 7, the sheets S deforming. As a result, the sheets S come into close contact with the friction portions 5*b* and 7*b* and the rings 12 made of frictional material. Further, the ring 13*a* made of frictional material presses the sheets S on the peripheral surface of the roller 6 made of frictional material. Consequently, high friction forces from rollers 5, 6, 7 and 8 and from the first endless belts 18 the direction of movement of which are opposite to each other act on the sheets S. Where two or more sheets S are fed to the position P1 simultaneously in such a manner that they are stacked, the frictional force from the first endless belts 18 acts on the uppermost sheet and the frictional force from the rollers 5, 6, 7 and 8, acts on the lowermost sheet. As a result, one sheet S to be taken out can be separated from the residual sheets S and, therefore, the sheets S can be fed one by one into the portion between the the rollers 5, 6, 7 and 8 and the first endless belts 18. FIG. 4 shows the positional relationship between the sheets S, the first endless belts 18 and the rollers 5, 6, 7 and 8 at this stage.

Figure 6:
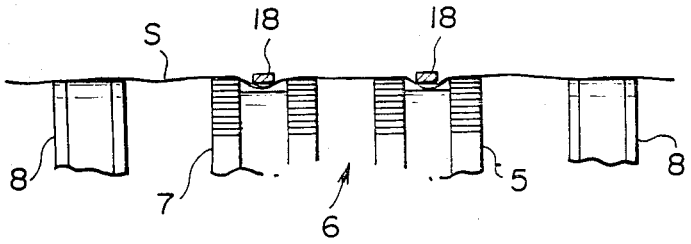
Figure 5:
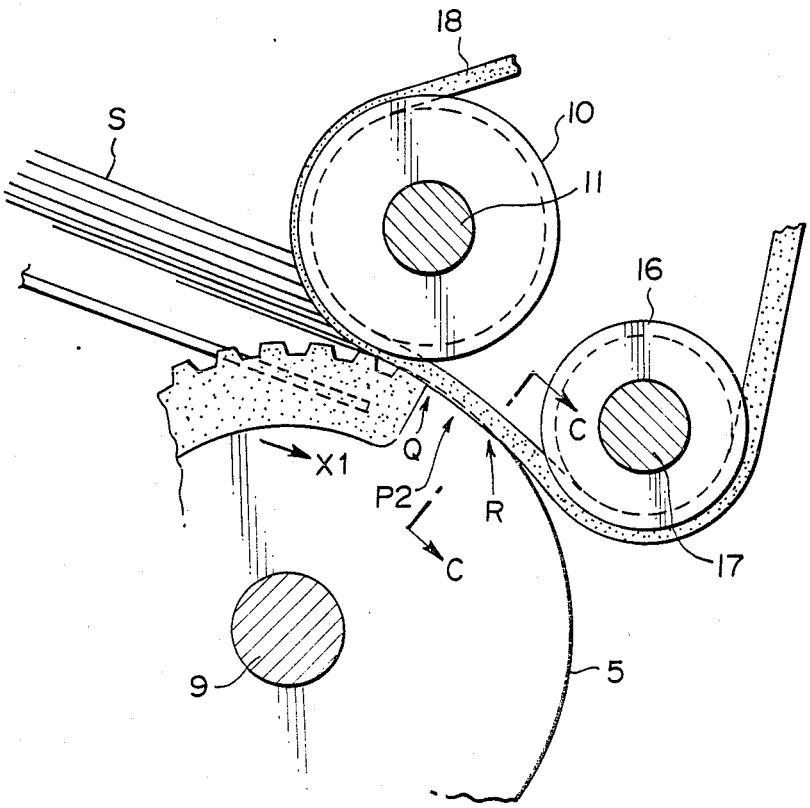

When the sheets S are fed further and arrives at the position P2 shown in FIG. 5, the first endless belts 18 force the sheets S into the grooves 5*a* and 7*a* of the rollers 5 and 7 and the sheets S is deformed at a region between positions Q and R. As a result, the sheets S comes into close contact with the friction portions 5*b*, 7*b* and the rings 12 made of frictional material. Further, the ring 13*a* made of frictional material presses the sheets S on the peripheral surface of the roller 6 made of frictional material. Consequently, high friction forces from the rollers 5, 6, 7 and 8 and the first endless belts 18 the directions of movement of which are opposite to each other act on the sheets. Where two or more sheets are simultaneously fed to this region in such a manner that they are stacked, the frictional force from the first endless belts 18 acts on the uppermost sheet and the frictional force from the rollers 5, 6, 7 and 8 acts on the lowermost sheet. Therefore, even if the sheet to be taken out has not yet been separated from the residual sheets, only one sheet is separated and fed co the next stage. FIG. 6 shows the positional relationship between the sheets, the first endless belts 18 and the rollers 5, 6, 7 and 8 at this stage.

Afterwards, the sheet is held by the guide rollers 8 and the second endless belts 23, and transported on in the direction indicated by an arrow X2.

According to the above described embodiment, since the rollers 5 and 7 included the take-out roller unit 4 are formed with the grooves 5*a* and 7*a* respectively and the first endless belts 18 made of frictional material and moving in the opposite direction to that of the sheets S are partly positioned in the grooves 5*a*, 7*a*, it is possible to apply strong frictional forces in opposite directions on the sheets S, and the one sheet to be taken out can be separated from the others even if two or more sheets are taken out from the stacker 1 by the feed roller 2. Particularly, at the position P1, the first endless belts 18 are backed up by the pulleys 10, it is possible to have sufficient frictional force act on the sheets S to improve sheet separation efficiency.

As described above with respect to the preferred embodiment, according to the present invention, it is possible to separate one sheet to be taken out from other sheets even if two or more sheets are taken out from a stacker, and take out the sheets from the stacker one by one.

The present invention has thus been shown and described with reference to the specific embodiment. However, it should be noted that the present invention is in no way limited to the details of the described arrangements but changes and modifications may be made without departing from the scope of the appended claims.

For example, although the take-out roller unit 4 consists of three rollers 5, 6 and 7 in the above described embodiment, a single roller having at least one groove on the peripheral surface thereof may be employed as the take-out roller unit.

We claim:

1. A sheet take-out apparatus for taking out sheets one by one from stacker means, said sheet take-out apparatus comprising:

feed roller means for feeding sheets one by one by engaging with a bottom surface of the lowermost sheet in said stacker means, take-out roller means having at least two grooves extending circumferentially on a peripheral surface thereof, said take-out roller means being disposed downstream of said feed roller means with respect to the direction of the feeding of sheets and rotated synchronously with the rotation of said feed roller means, said take-out roller means including a plurality of take-out rollers, a plurality of pulley means disposed facing at least two grooves and rotating in a direction opposite to that in which the sheets are fed, two annular rings of said plurality of pulley means projecting radially into a plane defining an outermost periphery of said take-out rollers and each of said two annular rings being spaced outwardly from a different peripheral end face of said take-out rollers which extends perpendicular to the direction of the feeding of sheets, and an additional at least one annular ring being located centrally between said two annular rings, and contacting the peripheral surface of the take-out rollers between said at least two grooves, and endless belt means made of frictional material, said endless belt means being mounted on said plurality of pulley means so that a part of said endless belt means is positioned in said at least two grooves and being moved in a direction opposite to that in which the sheets are fed, said sheets being fed by being held between the peripheral surface of said take-out roller means and said endless belt means.

2. A sheet take-out apparatus in accordance with claim 1 in which a part of the peripheral surface of said take-out roller means is made of frictional material.

3. A sheet take-out apparatus in accordance with claim 1 wherein said endless belt means is supported by at least one of said pulley means at a region where said endless belt means is positioned in said at least two grooves.

4. A sheet take-out apparatus for taking out sheets one by one from stacker means, said sheet take-out apparatus comprising:

feed roller means for feeding sheets one by one by engaging with a bottom surface of the lowermost sheet in said stacker means, take-out roller means having at least one groove extending circumferentially on a peripheral surface thereof, said take-out roller means being disposed downstream of said feed roller means with respect to the direction of the feeding of sheets and rotated synchronously with the rotation of said feed roller means, a plurality of fixed pulley means disposed facing said at least one groove and rotating in a direction opposite to that in which the sheets are fed, and endless belt means made of frictional material, said endless belt means being mounted in constant tension on said plurality of pulley means so that a part of said endless belt means is positioned in said at least one groove and being moved in a direction opposite to that in which the sheets are fed, said sheets being fed by being held between the peripheral surface of said take-out roller means and said endless belt means, said plurality of fixed pulley means being positioned furthest upstream with respect to the direction of feeding of the sheets by said plurality of fixed pulley means is being disposed so that a clearance between said at least one groove of said take-out roller means and said endless belt means is small enough for preventing two sheets from passing therethrough.

* * * * *

UNITED STATES PATENT AND TRADEMARK OFFICE

CERTIFICATE OF CORRECTION

PATENT NO. : 4,871,162

DATED : October 3, 1989

INVENTOR(S) : Shigetoshi Imai and Takao Akioka

It is certified that error appears in the above-identified patent and that said Letters Patent is hereby corrected as shown below:

On the title page, please insert the following:

--[73] Assignee: LAUREL BANK MACHINES CO., LTD., Tokyo, Japan--

Signed and Sealed this

Eighteenth Day of February, 1992

*Attest:*

HARRY F. MANBECK, JR.

*Attesting Officer*

*Commissioner of Patents and Trademarks*